United States Patent [19]

Wuthrich et al.

[11] 4,031,341

[45] June 21, 1977

[54] DUAL FUNCTION PUSHER AND ROTATE SWITCH FOR SOLID STATE DIGITAL WATCHES HAVING DETENT SPRING

[75] Inventors: Paul Wuthrich, Watertown; Frank P. Mascia, Bristol, both of Conn.

[73] Assignee: Timex Corporation, Waterbury, Conn.

[22] Filed: Jan. 14, 1976

[21] Appl. No.: 649,115

[52] U.S. Cl. ..... 200/52 R; 58/33; 58/34; 58/50 R; 58/85.5; 58/90 B; 200/4; 200/159 R

[51] Int. Cl.[2] ..... G04C 9/00; G04B 27/00; H01H 13/52

[58] Field of Search ..... 200/4, 6 R, 52 R, 159 B, 200/159 R; 58/4, 23 R, 50 R, 58, 85.5, 33, 34, 90 B

[56] References Cited

UNITED STATES PATENTS

| | | | |
|---|---|---|---|
| 3,526,088 | 9/1970 | Meitinger | 58/85.5 X |
| 3,783,607 | 1/1974 | Feurer | 58/90 B |
| 3,874,162 | 4/1975 | Boxberger et al. | 58/85.5 X |
| 3,877,217 | 4/1975 | Hochstrate | 58/85.5 |
| 3,952,176 | 4/1976 | Holder et al. | 58/85.5 X |
| 3,974,351 | 8/1976 | Solov et al. | 200/159 R |
| 3,975,897 | 8/1976 | Naito | 58/23 R |
| 3,978,296 | 8/1976 | Moriya et al. | 200/4 |

*Primary Examiner*—James R. Scott
*Attorney, Agent, or Firm*—Lawrence Hager

[57] ABSTRACT

A dual function pusher and rotate switch assembly for actuating, for example, a display light and/or time correction which includes a crown portion on the outside of the watch case and a shaft portion extending through the wall of the case. The shaft portion includes an intermediate section on the inside of the case which cooperates with a spring to provide a two position rotary detent action.

In addition to permitting detent holding of the stem in the proper contact position, the spring arrangement also enables biased axial movement of the stem. The internal end of the shaft includes an eccentric tab which contacts a precisely positioned first switch blade when the stem being in a first detent position is pushed-in or contacts a second switch blade if the crown is rotated to a second detent position. If the crown is pushed-in while in the second detent position, both switch blades are engaged causing actuation of two functions such as causing simultaneous illumination and updating of the display.

9 Claims, 3 Drawing Figures

DUAL FUNCTION PUSHER AND ROTATE SWITCH FOR SOLID STATE DIGITAL WATCHES HAVING DETENT SPRING

BACKGROUND OF THE INVENTION

The present invention relates to a dual function pusher and rotate device and switch assembly for solid state watches.

In the use of electronic watches, particularly multi-function digital watches, it is necessary to have switches which enable the user of the watch to select the desired display function, or to set the information being displayed, or to illuminate the display or to shut down or disconnect the power supply, i.e., the battery, from the watch circuitry. A rotate switch arrangement for actuating such functions in a digital watch is disclosed in commonly assigned U.S. Pat. No. 3,874,162 to Boxberger et al. issued Apr. 1, 1975, which includes a four position rotary detent action switch which permits adjustment of the displayed information.

Other prior art patents of interest include U.S. Pat. No. 3,757,512 to Zellweger et al, issued Sept. 11, 1973 and U.S. Pat. No. 3,783,607 to Feurer, issued Jan. 8, 1974. These prior art patents are merely typical of the art showing pusher switches to control separate watch functions such as to illuminate the display and are not in any way intended to be an all inclusive list of pertinent patents.

In contrast to the prior art, the present invention provides a switch assembly which combines the capabilities and advantages of both the pusher and rotate type switches, enables control of a multiple of functions either separately or simultaneously, is adapted for ease of use by the user of the watch and involves a minimum of associated parts.

SUMMARY OF THE INVENTION

The present invention relates to a dual function pusher and rotate device and switch assembly for solid state digital watches which comprises a crown portion on the outside of the watch case with a shaft portion having an intermediate detent retainer section in the portion immediately inside the case and an eccentric tab at the internal end thereof.

The crown is locked in one of a plurality of rotational tactile positions by the cooperating action of the spring and the detent retainer section of the shaft. The shaft is also capable of longitudinal motion by the action of the spring when the crown is pushed-in. The spring also includes outwardly extending portions which are biased against the case or bezel so that a high simultaneous contact pressure is provided between the stem and spring and case.

The eccentric tab on the end of the shaft is designed to engage with one or more of a plurality of switch blades either separately or jointly. For example, one of the switch blades is positioned to be longitudinally engaged by the eccentric tab with each depression of the crown and the other switch blade is positioned to be separately rotatably engaged by the eccentric tab when the crown is rotated to a predetermined detent position. Both switch blades are engaged when the crown is pushed-in while in this predetermined detent position.

Accordingly, an object of this invention is to provide a new and improved dual function stem assembly for a solid state digital watch.

Another object of this invention is to provide a new and improved combination detent and pusher spring arrangement for a solid state digital watch.

A further object of this invention is to provide a new single stem dual function pusher and rotate switch arrangement for a solid state digital watch.

A further object of this invention is to provide a multi-position stem detent and pusher arrangement and an internal switch arrangement.

BRIEF DESCRIPTION OF THE DRAWINGS

Other objects and advantages of this invention may be seen more clearly from the following description when viewed in conjunction with the accompanying drawings wherein.

DETAILED DESCRIPTION OF THE INVENTION

Figure 1:
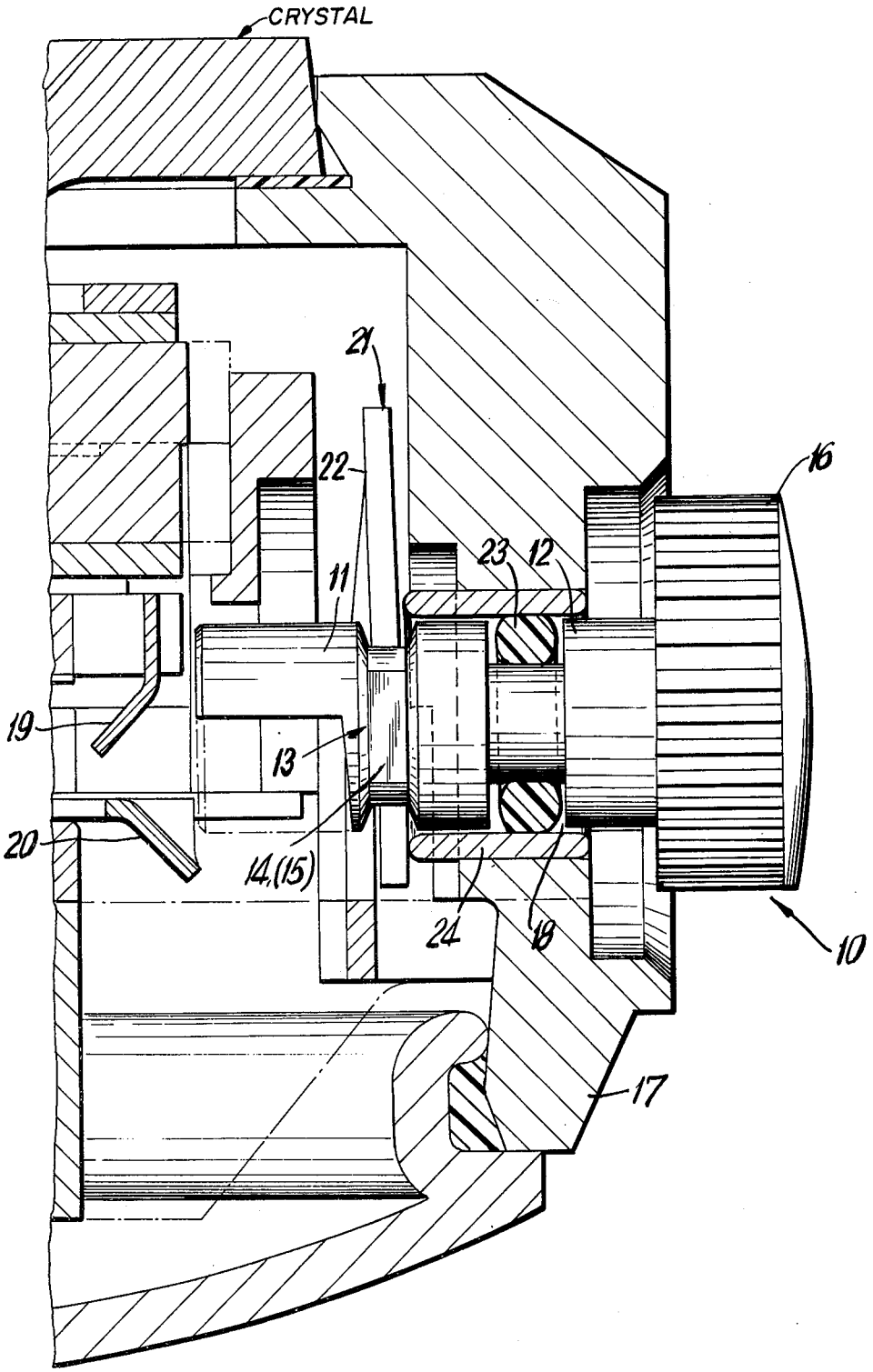
FIG. 1 is a side view of a first embodiment of the invention showing the dual pusher and rotate switch assembly and cooperating portions of the watch.

Referring to the drawings, particularly FIG. 1, the invention comprises a solid state watch stem assembly 10 which includes an eccentric tab 11 at one end, a main shaft portion 12, an intermediate detent retainer section 13 of lesser diameter than the shaft 12 which has flat portions 14, 15, another end portion having the watch crown 16 affixed thereto outside the case 17, and an annular groove 18 in the shaft 12 positioned to be between the openings in the case 17 with the shaft 12 being inserted therethrough.

The switch blades 19, 20 are, for example, thin beryllium copper stampings riveted or soldered to the solid state substrate (not shown). The switch blades are connected to an integrated circuit chip (not shown) through printed circuit leads. Since the connection of the switch blades to the integrated circuit is not pertinent to the present invention, reference is made to commonly assigned U.S. Pat. No. 3,874,162 which issued Apr. 1, 1975 for further detail thereof.

The switch blade 19 which is engaged by the tab 11 when the stem assembly 10 is depressed is the "light" switch blade and is coupled to the circuits and power supply (not shown) to energize a light source (not shown) to illuminate the watch face. Switch blade 20 is the "setting" switch blade and is coupled to the logic circuits (not shown) to provide the capability of selectively advancing or updating the information being displayed, for example, the minutes or hours.

The stem assembly 10 also permits detent holding of the stem in a proper contact position and provides electrical contact to ground the stem to the case. This is effected through the flat portions 14, 15 of the shaft. The flat portions 14, 15 engage a single stamped spring 21 to provide a two position rotary tactile detent action. The detent action is similar to that described in the previously mentioned commonly assigned U.S. Pat. No. 3,874,162 except that in the present invention a two position detent action is used and, therefore, this patent is herein incorporated for such details. Briefly, however, the spring 21 comprises a pair of spaced, substantially U-shaped arms extending upwardly from the base of the spring 21. The opposing legs of the spring 21 are spring biased into engagement with the flat portions 14, 15 and, also, spring biased and projected from the base connecting arms. However, as can be noted from the drawings, the spring 21, in accordance with the present invention, is preformed at a point 22 so as to exert not only a high simultaneous radial contact pressure between the stem portion and the arms but also a compressible outward spring pressure or bias on the stem.

In the operation of the device shown in FIG. 1, the wearer of the watch pushes-in or depresses the crown 16 by applying pressure thereto or rotates the crown 16 to one of several tactile detent positions. The crown 16 protrudes from the case 17 so that the wearer of the wristwatch may have access to it and to permit longitudinal movement of the shaft. The crown 16 is depressed or pushed-in against the spring 21 bias which returns the stem 10 to its protruded position upon release. During this motion of the stem, the eccentric tab 11 longitudinally engages a light switch blade 19 causing illumination of the display. The two flat portions 14, 15 in cooperation with the spring 21 allow for a two position detent of the eccentric tab 11. A first detent position effects orientation of the eccentric tab 11 in a plane above the setting switch blade 20 so that it does not engage this switch blade 20 when the crown is depressed. In this manner, the single function of illuminating the display is effected. If the crown is rotated, for example, 180° to a second detent position and pushed-in, the tab longitudinally engages the setting switch blade 20 causing update of the displayed information. During the motion of the stem 10, the gasket 23 applies pressure against the internal wall of the sleeve-type housing 24. The gasket 23, by applying pressure between the annular groove 18 and the internal wall of the housing 24 prevents dust and moisture from entering the interior of the watch case.

Figure 2:
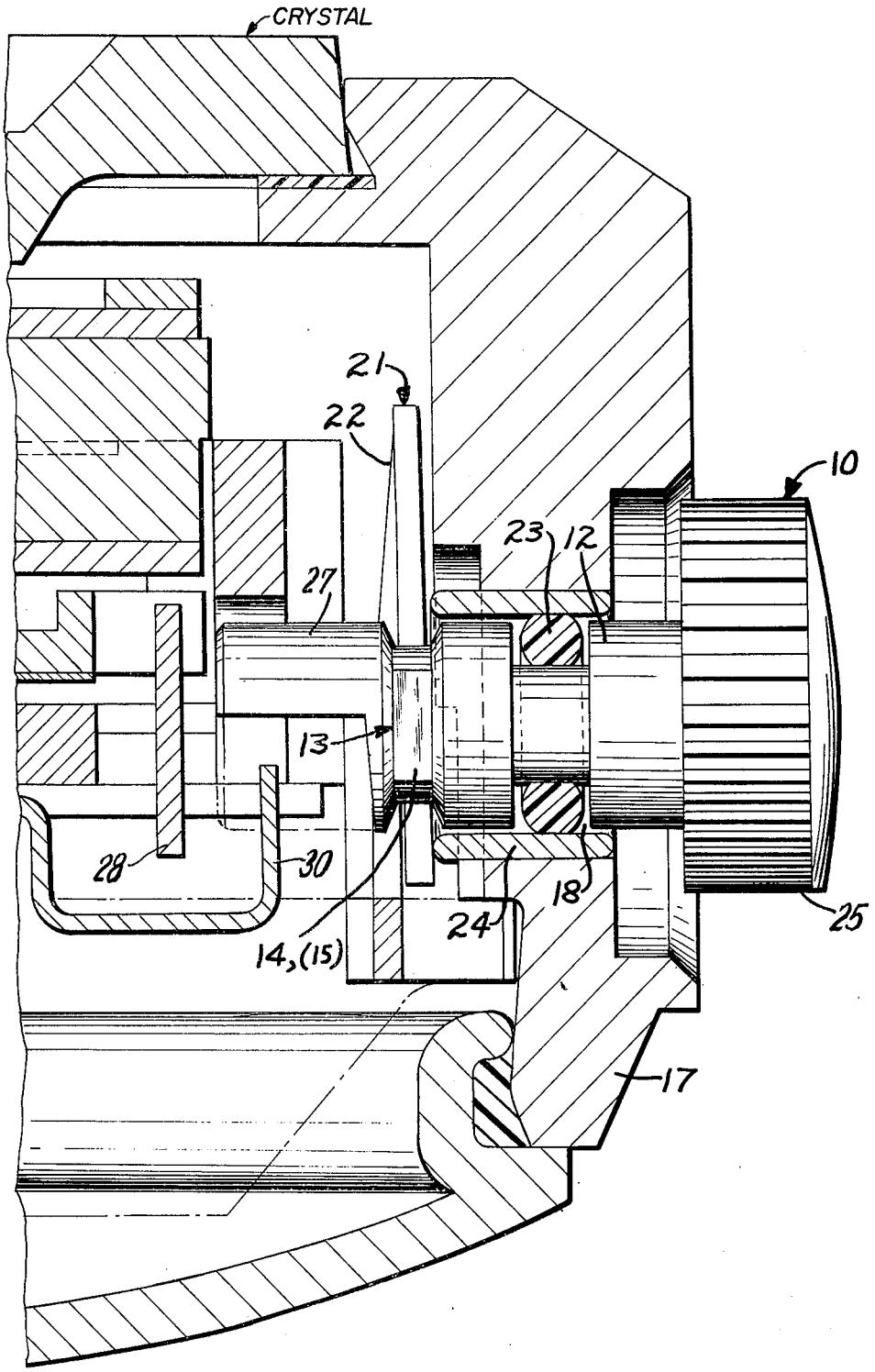
FIG. 2 is a side view of a second embodiment of the invention.

The second embodiment of the invention, shown in FIG. 2, is similar to the embodiment of the invention shown in FIG. 1 in that when the crown 25 is in a first detent position as shown and depressed, the eccentric tab 27 is in a position to longitudinally engage a first switch blade 28, for example, for causing distinction of separate display indicia such as the date to be displayed. However, this embodiment differs in that without pushing-in of the crown 29, but only rotated to a second detent position, e.g., rotated 180°, the eccentric tab 27 rotatably engages a second switch blade 30. If the stem 25 is also depressed when the eccentric tab 27 is in the detent position for contacting switch blade 30, the eccentric tab 27 will also contact or engage switch blade 28. The switch blade 30 is biased to permit longitudinal sliding motion of the eccentric tab 27 and to maintain contact therewith during this motion of the eccentric tab.

Figure 3:
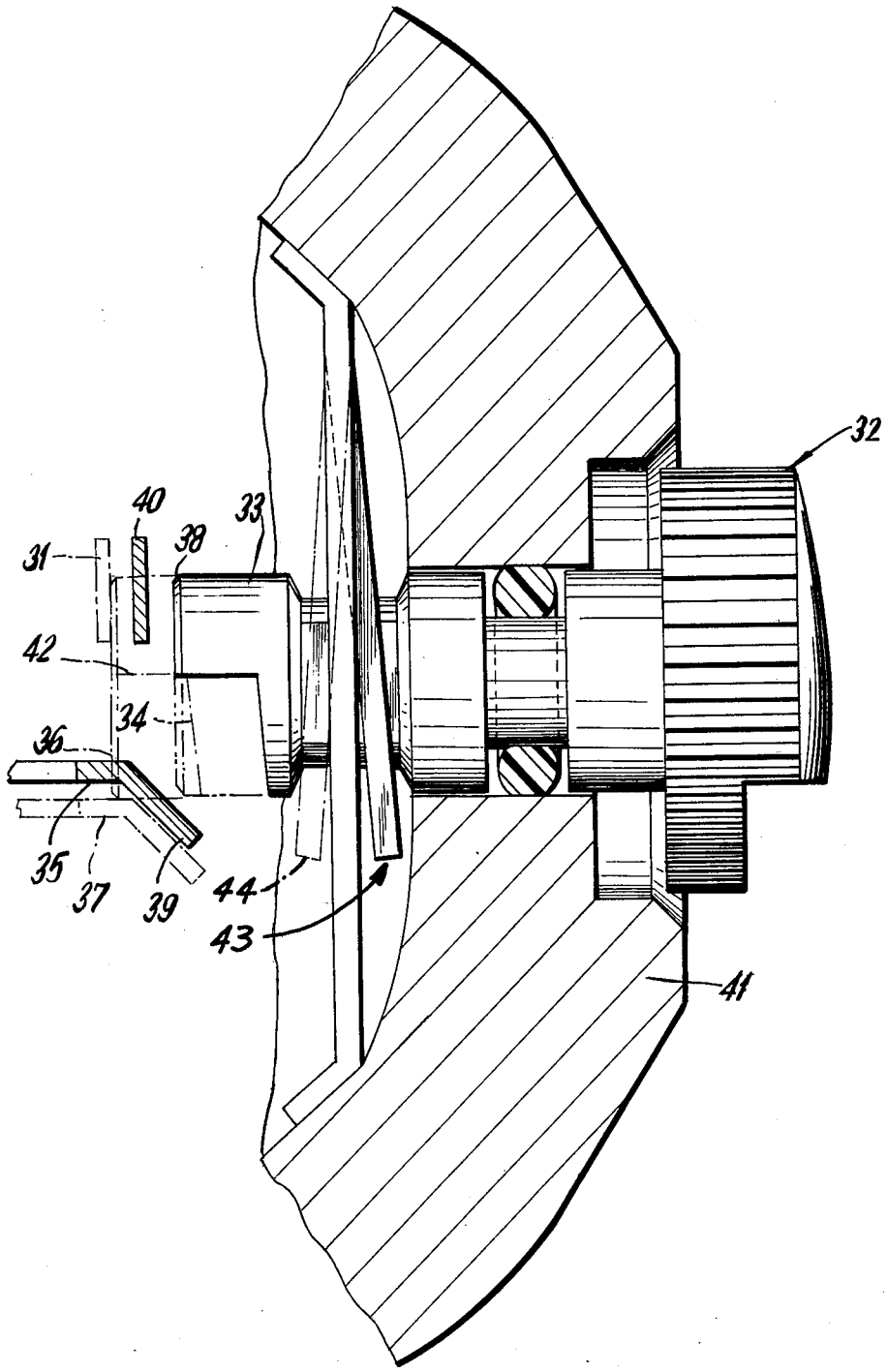
FIG. 3 is a side view of another embodiment of the invention.

With reference to FIG. 3, another embodiment of the present invention is shown. The switch assembly of this embodiment is similar to that shown in FIGS. 1 and 2 with the exception that the switch blades are positioned to function differently with respect to the eccentric tab and that the housing which cooperates with the gasket is eliminated. In this embodiment the gasket or sealing element cooperates with the interior wall of the case 41. And as illustrated by the dashed line 31, the switch blade 40 is precisely positioned such that with each depression of the stem 32, the eccentric tab 33 engages it. As illustrated by dashed lines 34, 36, 42, a second switch blade 35 is separately engaged by the eccentric tab 33 with each rotation and depression of the stem 32 to this detent and longitudinal position. The switch blade 35 is biased to permit longitudinal sliding motion of the eccentric tab 33 and to maintain contact therewith during this motion of the eccentric tab. This feature is illustrated by the dashed line 37. Both the eccentric tab 33 and switch blade 35 are contoured at 38, 39 so as to permit ease of motion and proper engagement of the eccentric tab 33 with the switch blades 40, 35. The spring comprises a pair of spaced substantially U-shaped arms 43 which are preformed to hold the crown 32 in an output position. The spring arms 43 are biased to permit longitudinal motion of the crown 32. This feature is illustrated by dashed line 44.

While certain specific embodiments have been set forth for the invention for the sake of illustration to persons skilled in the art, it is not intended to be limitative. For example, it should be recognized that the present invention is suited for a multi-position detent switch assembly having more than two detent positions.

We claim:

1. A dual function rotate and pusher device and switch assembly for an electronic watch having a case with an opening for access to the interior thereof which comprises:

a shaft mountable in said opening for axial and rotational movement and having an eccentric tab at the interior end thereof, and a detent retainer section, and an actuating end portion;

a plurality of switch blade means mounted for selective engagement with the eccentric tab; and biasing means engaging the detent retainer section and the shaft for providing longitudinal and detented rotational movement of the shaft to enable engagement with a selected switch blade by the eccentric tab with longitudinal and/or rotational movement of the shaft.

2. A dual function rotate and pusher device and switch assembly as in claim 1, wherein:

the plurality of switch blade means comprise a pair of spaced apart cantilevered blades.

3. A dual function rotate and pusher device and switch assembly as in claim 1, wherein:

the eccentric tab and a first switch blade are contoured for engagement with rotational movement of the shaft to a first detent position and to maintain a sliding engagement between said eccentric tab and said first switch blade while in said first detent position with longitudinal movement of said shaft.

4. A dual function rotate and pusher device and switch assembly as in claim 1, wherein:

the plurality of switch blade means comprise a first switch blade mounted for engagement with the eccentric tab with the stem being pushed-in in a first detent position, and a second switch blade mounted for engagement with the eccentric tab with the stem being pushed-in in a second detent position.

5. A dual function rotate and pusher device and switch assembly as in claim 1, wherein:

the plurality of switch blade means comprise a first switch blade mounted for engagement with the eccentric tab with the stem being pushed-in in a first detent position, and a second switch blade mounted for engagement with the eccentric tab with the stem being rotated to a second detent position.

6. A dual function rotate and pusher device and switch assembly as in claim 1, wherein:

the plurality of switch blade means comprise a first switch blade mounted for engagement with the eccentric tab with the stem being pushed-in in a first detent position and a second switch blade mounted for engagement with the eccentric tab with the stem being rotated to a second detent position, the first and second switch blades being also mounted so that the eccentric tab engages both the first and second switch blades when the stem is pushed-in when in the second detent position.

7. A dual function rotate and pusher device and switch assembly as in claim 1, wherein:

the detent retainer section of the shaft comprises flat portions on the shaft which reduces the diameter of the shaft in this section to provide a shoulder for engagement by the biasing means to bias the stem to permit axial movement thereof regardless of its rotational position during detenting.

8. A dual function rotate and pusher device and switch assembly as in clain 7, wherein:

the flat portions cooperate with the biasing means to provide a two position rotary detent action.

9. A dual function rotate and pusher stem device and switch assembly for a digital watch having a case with an opening for access to the interior thereof which comprises:

a shaft mountable in said opening for axial and rotational movement and having an eccentric tab at the interior end thereof, and an intermediate section having a detent retainer section, and an end portion projecting outwardly from the case;

a first switch blade mounted for selective engagement with the eccentric tab with the shaft being in a first detent position and pushed-in longitudinally;

a second switch blade mounted for selective engagement with the eccentric tab with the shaft being rotated to a second detent position;

biasing means engaging the detent retainer section to provide a detent action and for engaging the shaft to urge the shaft into a longitudinal position to disengage the eccentric tab from the first switch blade, said shaft being pushed-in longitudinally against the bias of the biasing means to a longitudinal position to engage the eccentric tab with the first switch blade, said biasing means returning said shaft to the disengaged longitudinal position upon release of the shaft.

* * * * *